US005681008A

United States Patent [19]

Kinstler

[11] Patent Number: 5,681,008

[45] Date of Patent: Oct. 28, 1997

[54] REMOTE IDENTIFICATION, LOCATION AND SIGNALING RESPONSE SYSTEM

[75] Inventor: Gary A. Kinstler, Torrance, Calif.

[73] Assignee: Boeing North American, Inc., Seal Beach, Calif.

[21] Appl. No.: 721,403

[22] Filed: Sep. 26, 1996

[51] Int. Cl.[6] ..... F41G 7/00; H04B 10/00

[52] U.S. Cl. ..... 244/3.11; 244/3.16; 89/1.56; 359/154; 367/77

[58] Field of Search ..... 367/77; 250/222.1; 359/155, 154, 159, 169, 170, 172; 102/206, 215; 244/3.11, 3.13, 3.16, 3.17; 382/103; 89/1.11, 1.56, 1.59

[56] References Cited

U.S. PATENT DOCUMENTS

| | | | |
|---|---|---|---|
| 4,091,734 | 5/1978 | Redmond et al. | 102/70.2 |
| 4,133,004 | 1/1979 | Fitts | 244/3.16 |
| 4,168,123 | 9/1979 | Price | 356/152 |
| 4,318,342 | 3/1982 | Chandler | 102/207 |
| 4,543,873 | 10/1985 | Stock | 89/1.59 |
| 4,666,103 | 5/1987 | Allen | 244/3.11 |
| 5,034,686 | 7/1991 | Aspelin | 324/158 |
| 5,036,465 | 7/1991 | Ackerman, Jr. et al. | 364/423 |
| 5,229,538 | 7/1993 | McGlynn et al. | 89/1.56 |
| 5,273,236 | 12/1993 | Wootton et al. | 244/3.11 |
| 5,282,421 | 2/1994 | Marsh et al. | 102/215 |
| 5,341,435 | 8/1994 | Corbett et al. | 382/103 |
| 5,350,134 | 9/1994 | Crawford | 244/3.11 |
| 5,550,787 | 8/1996 | Rialan et al. | 367/77 |
| 5,570,220 | 10/1996 | Matsumoto et al. | 359/172 |

*Primary Examiner*—Michael J. Carone
*Assistant Examiner*—Theresa M. Wesson
*Attorney, Agent, or Firm*—Lawrence N. Ginsberg; Charles T. Silberberg

[57] ABSTRACT

A wireless apparatus and communication system for remotely determining the unique identification of individual remote devices, among a plurality of remote devices, and to simultaneously determine the location of each individual remote device, associated with its unique identification number. This invention further provides a wireless signaling response capability for the purpose of relaying generic digital data from a remote device to a host system.

17 Claims, 6 Drawing Sheets

REMOTE IDENTIFICATION, LOCATION AND SIGNALING RESPONSE SYSTEM

BACKGROUND OF THE INVENTION

1. Field of the Invention

The present invention pertains to a wireless communication system for identification and location of remote devices and for relaying digital information to and from the remote devices. The invention is particularly directed to an aircraft armament system with a plurality of munitions which require pre-conditioning initialization prior to release, but which have no direct wire umbilical connection to the host vehicle.

2. Description of the Related Art

Todays weapons systems increasingly rely on the use of precision guided munitions (PGM's) to improve the accuracy with which ordnance may be delivered to a target, thereby increasing the damage expectancy for each weapon, and reducing the number of weapons and delivery platforms which must be utilized to achieve the desired level of damage. Reducing the number of weapons and sorties which must be committed to achieve a desired damage expectancy result minimizes crew exposure to enemy defenses and offers the potential for substantially reduced munitions and operations costs.

Today's PGM's require varying degrees of prelaunch preparation, or initialization, to enable and prepare the PGM's guidance system, and control targeting and launch sequencing. Further, the host platform requires status information from the PGM's during the course of the prelaunch initialization process to assess the launch readiness of the PGM's. This is most frequently accomplished by a hardwire umbilical between the host platform and the PGM. A hardwire connection affords the ability to uniquely and individually communicate between the host platform and each PGM such that instructions unique to each PGM may be dispatched by the host platform, and status received, by simply addressing the appropriate hardwire umbilical.

Recent innovations to reduce the cost of upgrading host platforms to interface with PGM's have resulted in the elimination of the hardwire umbilical to PGM's, using instead a "virtual umbilical" consisting of some kind of wireless interface and self-contained munitions power. Current implementations of the virtual umbilical interface require the host platform to have a prior knowledge of each munition's unique identification address so that individual wireless messages broadcast and received by a plurality of munitions within range of the communications system may be addressed to a unique munition. Many implementations also require that the PGM unique identification number associated with specific carriage stations on the host vehicle be known by the host vehicle. Such requirements of the current virtual umbilical implementations impose additional weapon preparation and loading effort to insure that individual PGM's get loaded onto the host platform at specific pre-planned stations, as well as introduce additional opportunity for human error.

Wireless communications between sending and receiving devices, where a plurality of devices is within range of the sending device, requires that unique remote device identification be established before communication may be directed to a specific remote device. Existing technology, such as desktop personal computer communication to unconnected accessories over a multi-party infrared communication link use protocols to accomplish this purpose, but to date can only be implemented at sub-meter ranges.

This invention provides an apparatus and protocol sufficient to meet the several-meter range requirements of the intended application.

There is clearly a need to reduce the procedural complexities and workload of the current virtual umbilical implentations to make the virtual umbilical for PGM's easy to use and therefore significantly more attractive to potential customers.

OBJECTS AND SUMMARY OF THE INVENTION

It is, therefore, a principal object of the present invention to remove the taxing requirement for a prior knowledge of individual munition's unique identification number, and the requirement to load a specific PGM to a specific store location. This invention accomplishes this by providing the capability to determine the unique weapon identification numbers and to determine the weapon's store location after they are loaded on the host platform. This permits PGM weapons to be loaded with the same flexibility as weapons which do not require any prelaunch conditioning or initialization.

Another object of the present invention is to provide a means of relaying digital information from one or more remote devices to the host system.

These and other objects are achieved by the communications apparatus of the present invention, which is embodied in a host carrier aircraft. The apparatus is based on the known capabilities of current wireless virtual umbilical implementations which provide a downlink (host system to remote device) communications capability for passing prelaunch initialization data to a remote device, to a weapon, as well as a means for requesting information from said remote devices. The apparatus of the invention is capable of providing a low cost means of uplink communications (from remote device to host system) for obtaining status information from remote devices, while also providing a user-friendly capability for remote device identification and location.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
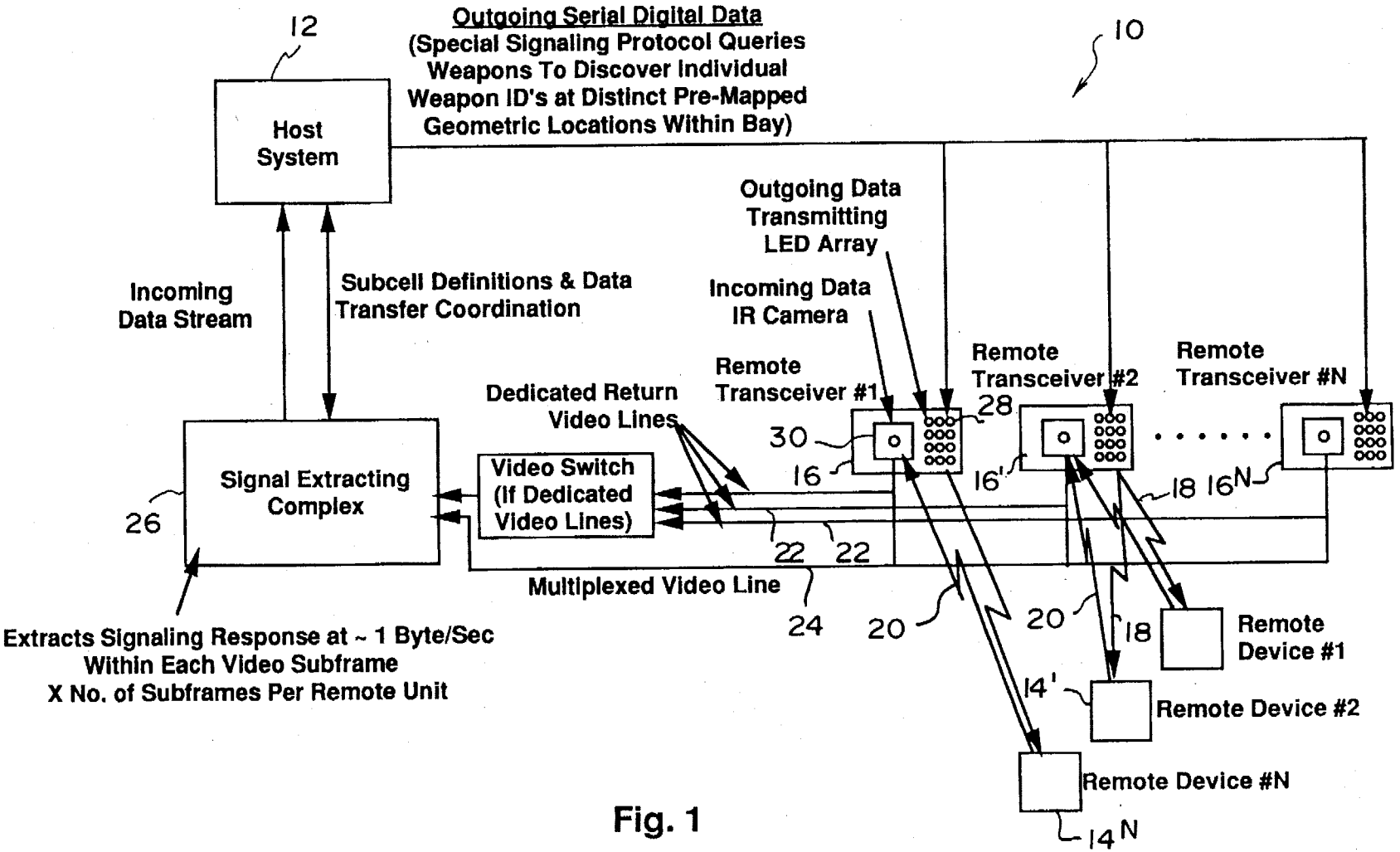
FIG. 1 is a block diagram showing the hardware used in the Remote Identification, Location, and Signaling Response System of the present invention.

Referring now to the drawings and the characters of reference marked thereon, FIG. 1 illustrates a preferred embodiment of the present remote identification location and signaling response system of the present invention, designated generally as 10. The present system 10 establishes one-to-one communication between a host system 12 and desired remote devices 14, 14', and 14$^N$. Remote transceivers 16, 16', 16$^N$ transmit a communications request 18 from the host system 12 to the remote devices 14, 14', 14$^N$. The transceivers 16 receive a signaling response 20 from the remote devices 14. The remote transceivers 16 provide pixel mapped signals 22 or 24, which are received by a signal extracting processing complex 26.

The signal extracting processing complex 26 extracts time bearing signals from the pixel mapped signals 22 or 24. As will be discussed in detail below, the signal extracting processing complex 26 includes a processor unit for determining signal variations from a series of sequential frames and for relaying a data stream corresponding to the signal variations.

The host system 12 may be, for example, an aircraft weapon delivery platform or other system in which a plurality of devices may be located anywhere in an array of remote locations and it is desired to establish unique one-to-one communication between the host system and the remote devices.

It is particularly useful in instances in which there is no prior knowledge of the unique identification number of the remote devices. One of the primary objectives of this communication technique is to establish the unique identification of each remote device 14, so that one-to-one communication can be established between the host system 12 and each remote device 14. A second objective is to enable relaying digital information from the remote device 14 to the host system 12, such as status information.

The outgoing communication request from the host system 12 to the transceivers 16 is typically a serial digital message of 2.4–19.2 Kbit/sec. It is typically transmitted by an array of light emitting diodes (LEDs) 28 in the infrared spectrum. The communication line between the host system 12 and the transceivers 16 also contains control information for recovering the signal response from the remote devices 14 and relaying it to the signal extracting complex 26. The nature of the messages being transmitted through the light emitting diodes from the host system will typically relay data from the host system 12 to the remote devices 14 for the purposes of initializing the remote devices 14 or request information such as identification number or status.

Information being transferred both to and from the remote transceivers 16 are preferably in the infrared spectrum. The communications request 18 and the signaling response 20 allow the invention to uniquely identify each remote devices 14, as will be clarified below.

Several protocols may be employed to encode signaling responses 20. Examples include binary coded, pulse width or pulse position modulation techniques. The preferred protocol for this response is a two-byte binary coded word containing a remote device unique identification number or other requested information. The bit-mapped signaling response from the remote devices 14 from the remote transceivers 16 is provided to the extracting complex 26 via either a multiplex video line 24 or dedicated return video lines 22. The advantages of utilizing a multiplex video line 24 is that a single shared copper transmission line may be used to communicate a plurality of returning signals over that single line 24 minimizing aircraft wiring harness requirements. Dedicated return video lines 22 offer the advantage of the increased total video transmission capability between the multiple transceivers 16 and the signal extracting complex 26.

The remote transceivers 16 include the array of LEDs 28, which are driven in response to messages from the host system 12. The transceivers 16 also include a TV camera, preferably restricted to the infrared spectrum. The infrared camera is preferably a solid state charge coupled device (CCD) camera. Also, within the transceiver 16, is included video multiplexing switching circuits or multiple line drivers.

The signaling responses 20 from the remote devices 14 are encoded and recoverable in a range of from about 5–30 bits/sec., preferably at about 1–2 bytes/sec. (approximately 10–20 bits/sec.).

Figure 2:
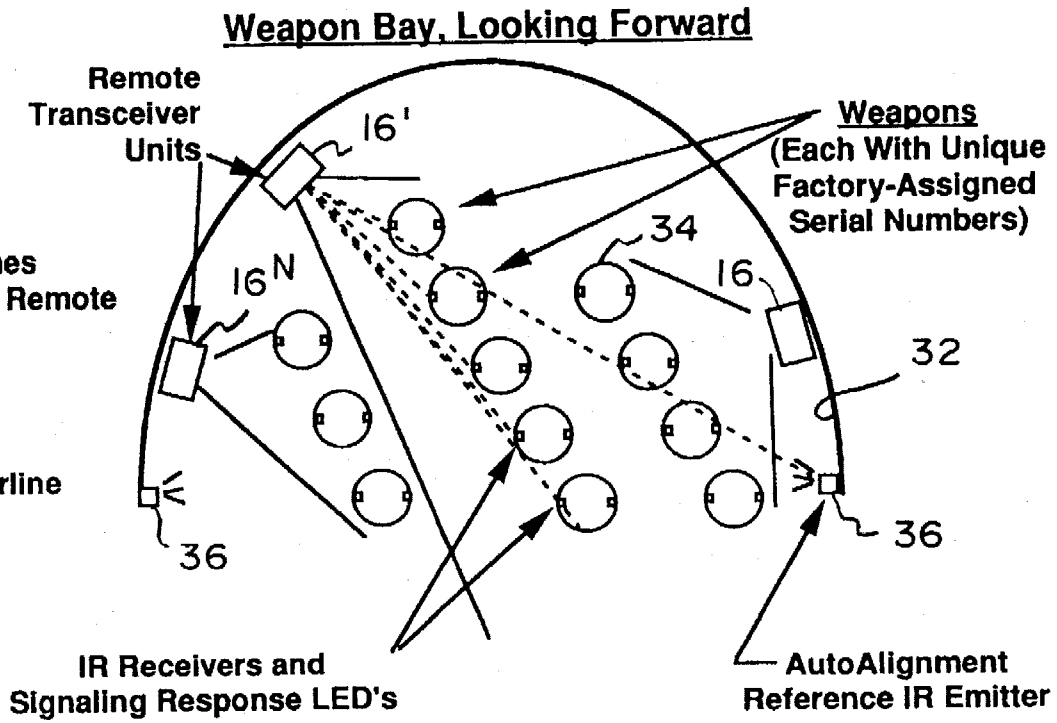
FIG. 2 is a diagram illustrating the geometric layout of some of the hardware for a typical embodiment employed in a armament system application.

Referring now to FIG. 2, a diagram is shown illustrating the geometric layout for an application of the present invention with an armament system. The transceivers 16 are mounted to the inner surface of a weapon bay 32, which collectively provide a line-of-sight optical communication path between each weapon 34 and at least one transceiver 16. At least one reference IR emitter 36 is positioned within the field of view of each remote transceiver unit 16 for providing alignment reference to the remote device 14. The signaling response capabilities of the munitions 34 are compatible with the detection sensitivities of the infrared cameras 16 and spatial discrimination capabilities of the infrared camera field of view, thus making the inventive principles herein particularly adaptable for use in weapons bay applications.

Figure 3:
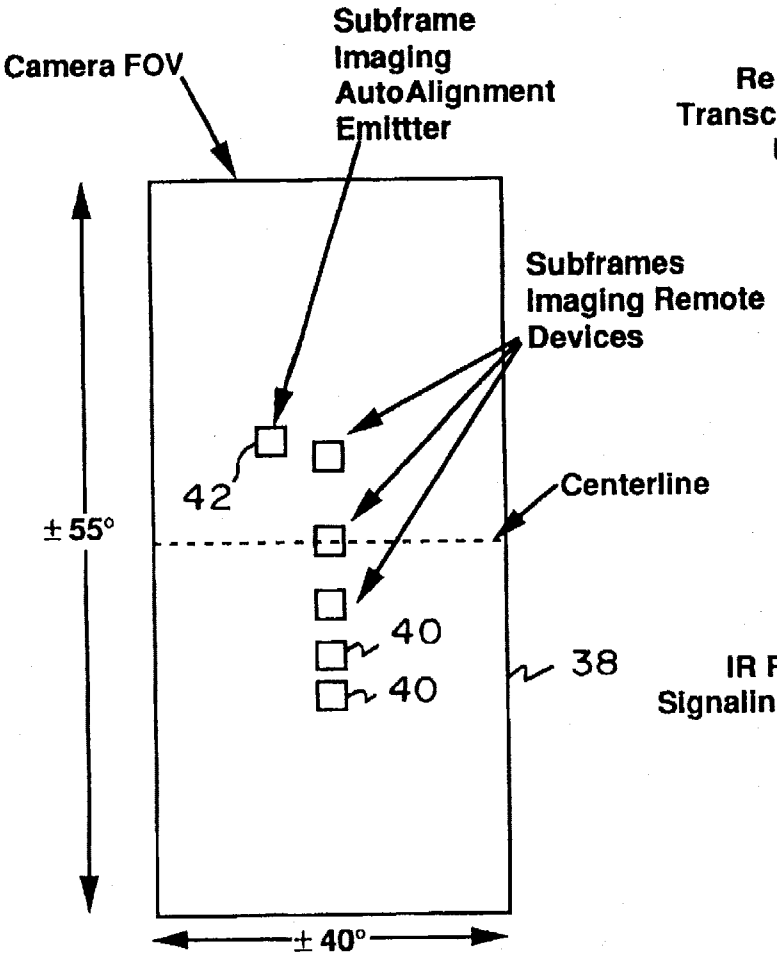
FIG. 3 is a diagram illustrating the field of view of an individual television camera used to image the location of remote devices, and subframe areas which define the possible locations of remote devices within the field of view.

Referring now to FIG. 3, depicted is a field of view 38 of the IR CCD camera and imaging subframes 40, which constrain the possible locations of the munitions within a weapon bay application. Signaling responses detected within these subframes 40 allow the present invention to independently recover signaling responses from individual munitions located at those positions. The subframe 42 represents the position boundaries of the autolocation IR emitter 36.

Figure 4:
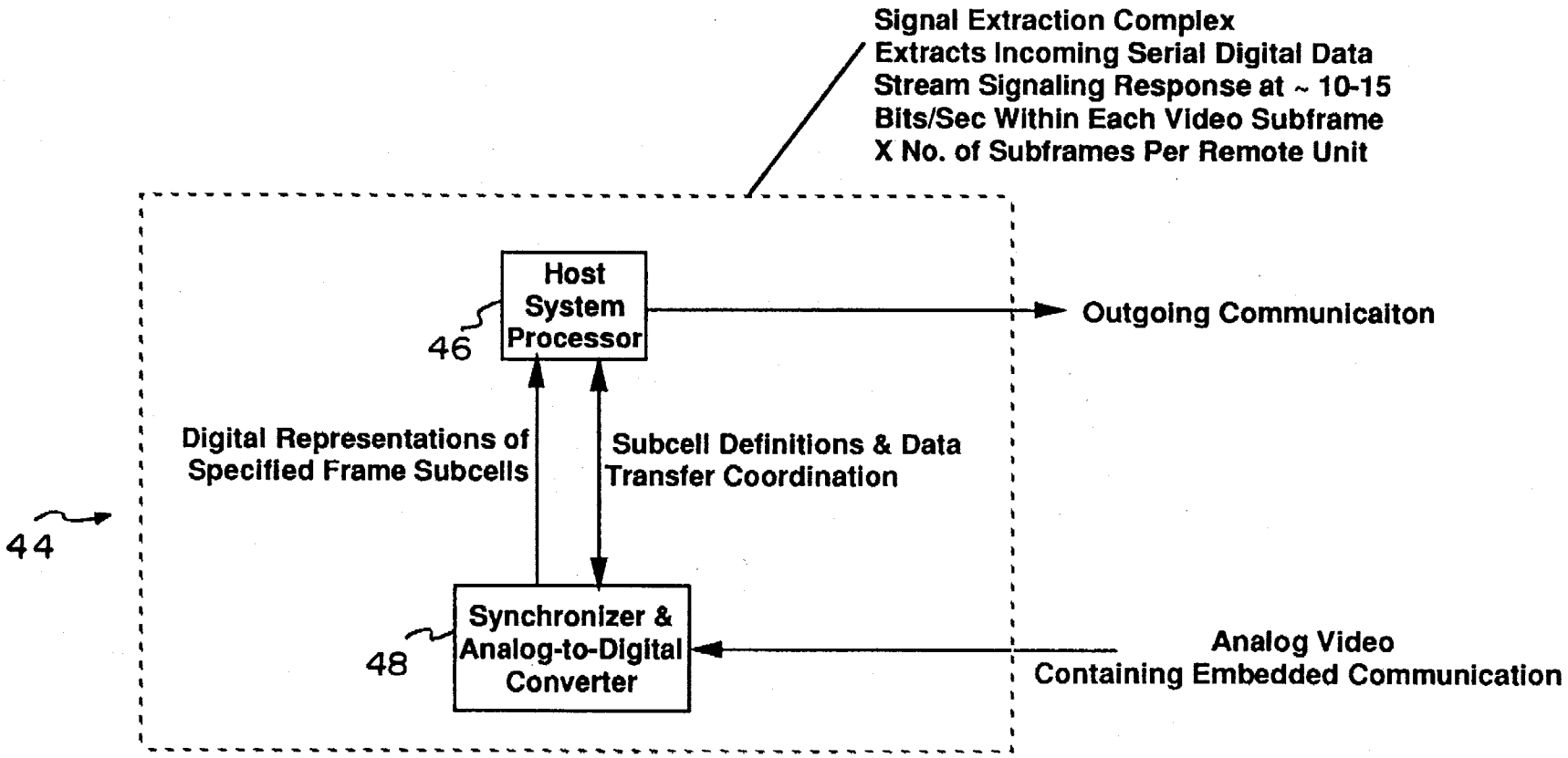
FIG. 4 is a diagram illustrating a first embodiment of the Signal Extracting Complex function shown in FIG. 1.

Referring now to FIG. 4, a first example of a signaling extracting complex is illustrated, designated generally as 44. In this instance, the host system processor 46 is tasked or utilized to extract the digital data from the received bit mapped video after being processed by a synchronizer and analog-to-digital converter unit 48. The synchronizer and analog-to-digital converter unit 48 receives the pixel mapped signal and converts it to an equivalent digital representation within specific spatial cells of the imaging area of a respective remote transceiver, the digital representation being transmitted to the processor 46.

Figure 5:
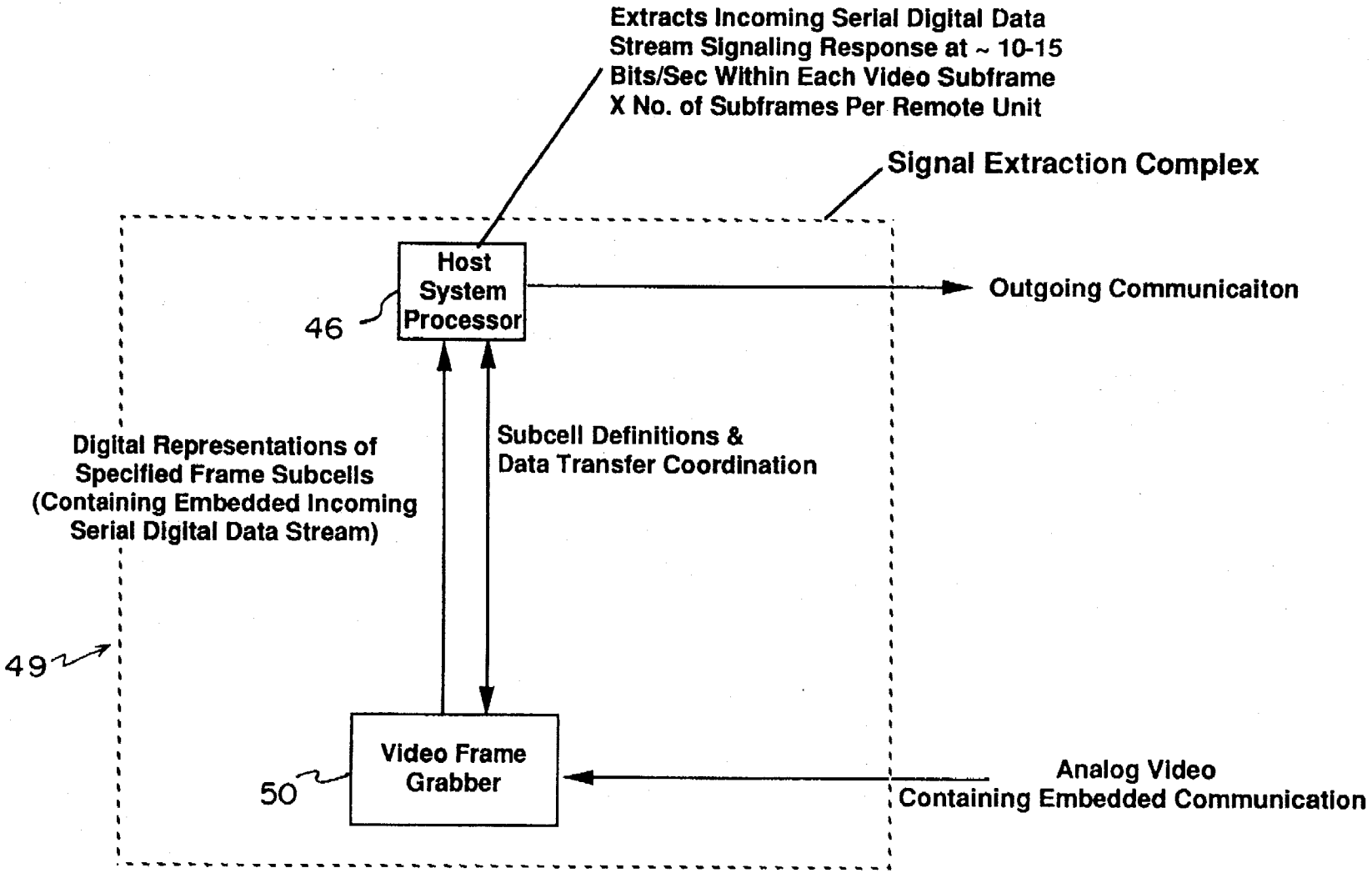
FIG. 5 is a diagram illustrating a second embodiment of the Signal Extracting Complex function shown in FIG. 1.

Referring now to FIG. 5, a variance of the FIG. 4 embodiment is illustrated, designated generally as 49, in which a synchronizer and analog-to-digital converter unit 48 is replaced with a readily commercially available electronic assembly designed for that purpose, referred to as a video frame grabber 50. The video frame grabber 50 receives the pixel mapped signal, this pixel mapped signal comprising an entire frame. This pixel mapped signal is converted to an equivalent digital representation, the digital representation being transmitted to the processing unit 46 for extraction of frame-to-frame signaling information.

Figure 6:
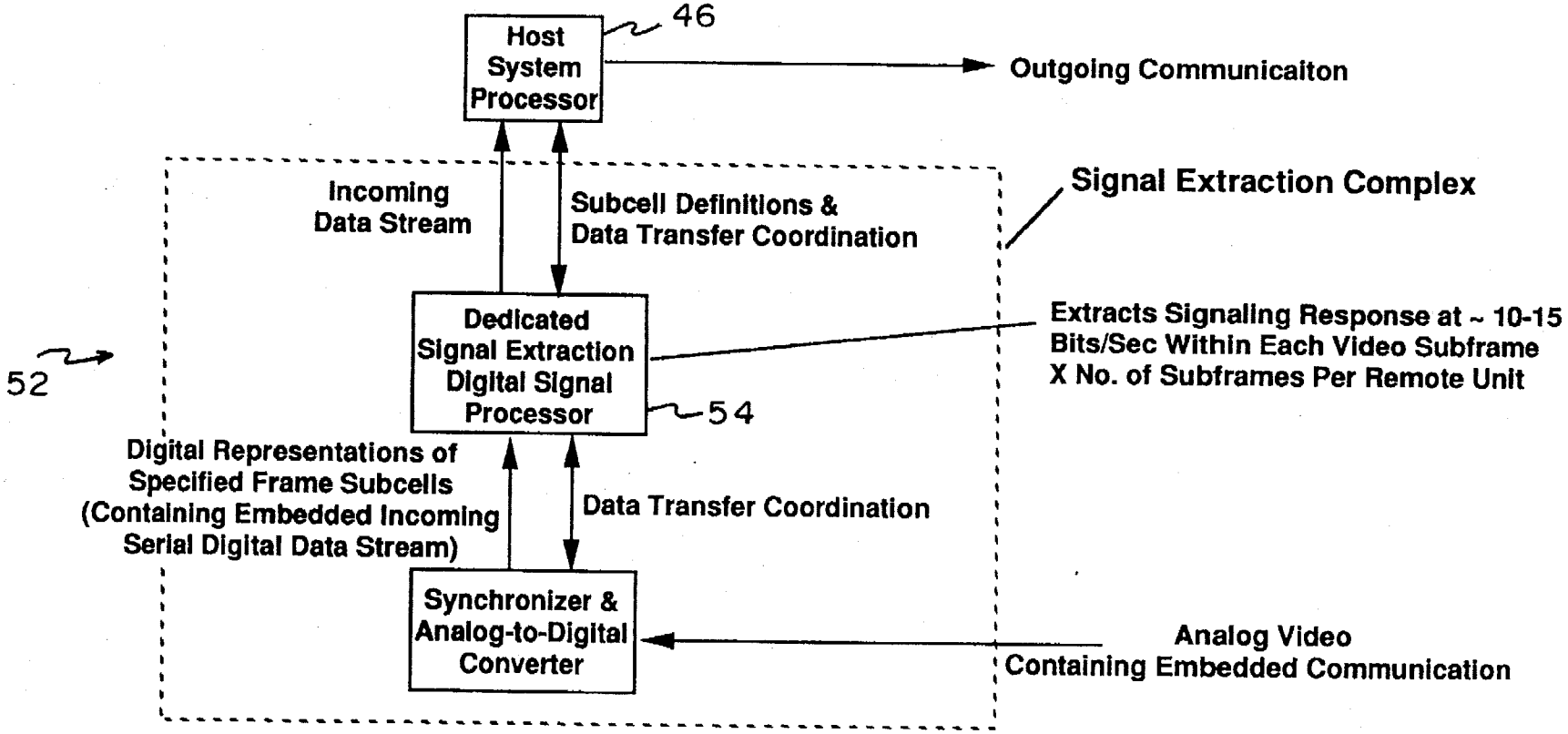
FIG. 6 is a diagram illustrating a third embodiment of the Signal Extracting Complex function shown in FIG. 1.

Referring now to FIG. 6, a third embodiment is illustrated, designated generally as 52. The FIG. 6 embodiment is a variant of the FIG. 4 embodiment, where the video processing tasks are now assumed by a dedicated signal extraction digital signal processor 54. The processor 54 relays the recovered bit information to the host system processor 46.

Figure 7:
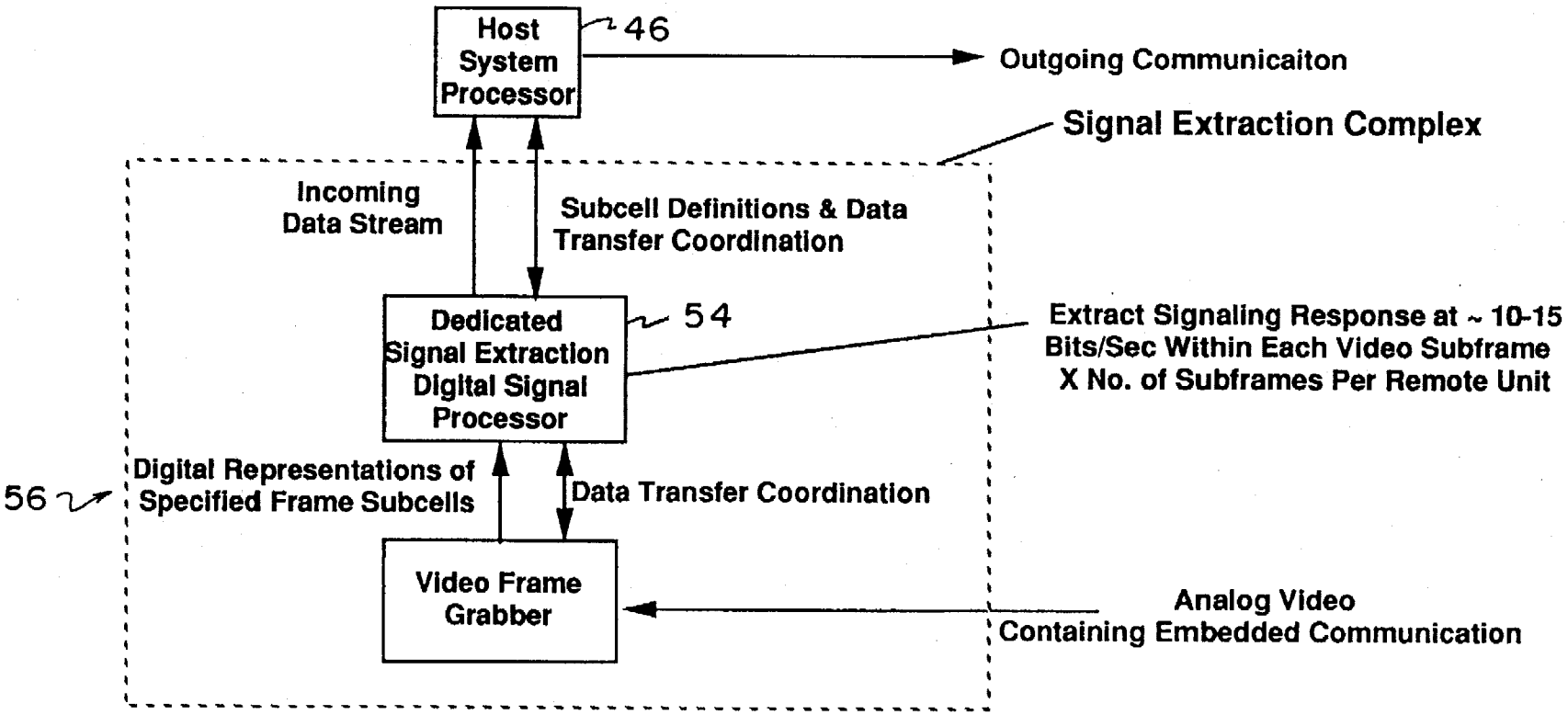
FIG. 7 is a diagram illustrating a fourth embodiment of the Signal Extracting Complex function shown in FIG. 1.

The FIG. 7 embodiment, designated generally as 56, is a variant of the FIG. 5 embodiment, where the video processing functions are assumed by a dedicated signal extraction digital signal processor 54, and only the recovered signal information is passed on the host system processor 46.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A remote identification, location and signaling response system for establishing one-to-one communication between a host system and desired remote devices, comprising:

a) at least one remote transceiver for transmitting a communications request from a host system to at least one remote device and for receiving a signaling response from said at least one remote device, said remote transceiver providing a pixel mapped signal; and, b) a signal extracting processing complex for receiving said pixel mapped signal and extracting time varying signals therefrom, said signal extracting processing complex, comprising a processor unit for determining signal variations from a series of sequential frames and for relaying a data stream corresponding to said signal variations.

2. The remote identification, location and signaling response system of claim 1, wherein said communications request and said signaling response are in the infrared spectrum.

3. The remote identification, location and signaling response system of claim 2, wherein said at least one remote device comprises at least one remote weapon.

4. The remote identification, location and signaling response system of claim 1, wherein said communications request and said signaling response uniquely identify each remote device.

5. The remote identification, location and signaling response system of claim 1, wherein said signaling response employs a serial digital protocol of binary modulation which encodes a unique identification number of the remote device.

6. The remote identification, location and signaling response system of claim 5, wherein said serial digital protocol comprises a two-byte binary coded word containing said remote device unique identification number.

7. The remote identification, location and signaling response system of claim 1, wherein said signaling response employs a serial digital protocol of pulse width or pulse position modulation which encodes a unique identification number of the remote device.

8. The remote identification, location and signaling response system of claim 1, wherein said signal extracting processing complex, comprises:

a synchronizer and analog-to-digital converter unit for receiving said pixel mapped signal and converting it to an equivalent digital representation within specific spatial cells of the imaging area of a respective remote transceiver, said digital representation being transmitted to said processing unit.

9. The remote identification, location and signaling response system of claim 1, wherein said signal extracting processing complex, comprises:

a video frame gabber for receiving said pixel mapped signal, said pixel mapped signal comprising an entire frame, said pixel mapped signal being converted to an equivalent digital representation, said digital representation being transmitted to said processing unit for extraction of frame-to-frame signaling information.

10. The remote identification, location and signaling response system of claim 1, wherein said processing unit comprises a digital signal processor.

11. The remote identification, location and signaling response system of claim 1, wherein said signal extracting processing complex, comprises:

a synchronizer and analog-to-digital converter unit for receiving said pixel mapped signal and converting it to an equivalent digital representation within specific spatial cells of the imaging area of a respective remote transceiver, and, wherein said processor unit, comprises a signal extraction digital signal processor for receiving said equivalent digital representation for extracting said data stream from a series of sequential frames, said digital data stream being transmitted to a host system.

12. The remote identification, location and signaling response system of claim 1, wherein said signal extracting processing complex, comprises:

a video frame grabber for receiving said pixel mapped signal, said pixel mapped signal comprising an entire frame, said pixel mapped signal being converted to an equivalent digital representation; and, wherein said process unit comprises a signal extraction digital signal processor for receiving said equivalent digital representation for extracting said data stream from a series of sequential frames, said digital data stream being transmitted to a host system.

13. The remote identification, location and signaling response system of claim 1, further including at least one reference IR emitter positioned within the field of view of said at least one transceiver unit for providing alignment reference to said at least one remote device.

14. The remote identification, location and signaling response system of claim 1, wherein said pixel mapped signal is transmitted between said at least one transceiver and said signal extracting processing complex by a shared multiplex video transmission line.

15. The remote identification, location and signaling response system of claim 1, wherein said pixel mapped signal is transmitted between said at least one transceiver and said signal extracting processing complex by dedicated video transmission lines and a video switch.

16. The remote identification, location and signaling response system of claim 1, wherein said time varying signals are independent and simultaneously recoverable.

17. The remote identification, location and signaling response system of claim 1, wherein said time varying signals are recoverable in a range of from about 5–30 bits/sec.

* * * * *